US012281279B2

(12) United States Patent
Bouvier et al.

(10) Patent No.: US 12,281,279 B2
(45) Date of Patent: Apr. 22, 2025

(54) LUBRICATING COMPOSITION FOR ELECTRIC VEHICLES

(71) Applicant: TOTALENERGIES ONETECH, Courbevoie (FR)

(72) Inventors: Goulven Bouvier, Solaize (FR); Richard Vernay, Solaize (FR)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 17/922,567

(22) PCT Filed: May 4, 2021

(86) PCT No.: PCT/EP2021/061763
§ 371 (c)(1),
(2) Date: Oct. 31, 2022

(87) PCT Pub. No.: WO2021/224285
PCT Pub. Date: Nov. 11, 2021

(65) Prior Publication Data

US 2023/0167380 A1 Jun. 1, 2023

(30) Foreign Application Priority Data

May 5, 2020 (FR) ..... FR2004452

(51) Int. Cl.
*C10M 171/02* (2006.01)
*C10N 10/04* (2006.01)
(Continued)

(52) U.S. Cl.
CPC ..... *C10M 171/02* (2013.01); *C10N 2010/04* (2013.01); *C10N 2030/02* (2013.01);
(Continued)

(58) Field of Classification Search
CPC ..... C10M 171/02; C10M 171/00; C10M 169/04; C10N 2010/04; C10N 2030/02;
(Continued)

(56) References Cited

U.S. PATENT DOCUMENTS 8,400,030 B1 * 3/2013 Tang ..... B60L 3/0061 310/90
2005/0070446 A1 * 3/2005 Hewette ..... C10M 169/04 508/569
(Continued)

FOREIGN PATENT DOCUMENTS

EP 2 348 093 A1 7/2011
EP 2 650 348 A1 10/2013
EP 2 966 155 A1 1/2016

OTHER PUBLICATIONS

Cizaire et al., "Chemical analysis of overbased calcium sulfonate detergents by coupling XPS, ToF-SIMS, XANES, and EFTEM", Colloids and Surfaces A: Physicochem. Eng. Aspects 238 (2004), pp. 151-158.
(Continued)

*Primary Examiner* — Ellen M McAvoy
(74) *Attorney, Agent, or Firm* — Birch, Stewart, Kolasch & Birch, LLP

(57) ABSTRACT

The present invention relates to a lubricating composition comprising at least one base oil and at least one additive chosen from anti-wear additives, extreme pressure additives, antioxidants, anti-corrosion additives, metal deactivator additives, anti-foam agents, dispersants and mixtures thereof,
said composition having a boron concentration less than or equal to 100 ppm by weight and a nitrogen concentration strictly greater than 100 ppm by weight and less than or
(Continued)

equal to 500 ppm by weight, with respect to the total weight of the lubricating composition.

17 Claims, 1 Drawing Sheet

(51) Int. Cl.

| | |
|---|---|
| *C10N 30/00* | (2006.01) |
| *C10N 30/02* | (2006.01) |
| *C10N 30/04* | (2006.01) |
| *C10N 40/00* | (2006.01) |
| *C10N 40/04* | (2006.01) |
| *C10N 40/25* | (2006.01) |

(52) U.S. Cl.
CPC ..... *C10N 2030/04* (2013.01); *C10N 2030/44* (2020.05); *C10N 2040/04* (2013.01); *C10N 2040/25* (2013.01); *C10N 2040/40* (2020.05)

(58) Field of Classification Search
CPC ..... C10N 2030/04; C10N 2030/44; C10N 2040/04; C10N 2040/25; C10N 2040/40; C10N 2030/06; C10N 2040/16; C10N 2040/14
See application file for complete search history.

(56) References Cited

U.S. PATENT DOCUMENTS

| | | | | |
|---|---|---|---|---|
| 2011/0212863 | A1* | 9/2011 | Yagishita | C10M 169/04 508/192 |
| 2016/0024417 | A1* | 1/2016 | Kamano | C10M 141/12 508/192 |
| 2020/0157460 | A1* | 5/2020 | Kubo | C10M 129/54 |
| 2020/0216774 | A1* | 7/2020 | Abraham | C10M 163/00 |
| 2020/0369978 | A1* | 11/2020 | Higuchi | C10M 135/36 |
| 2021/0301217 | A1* | 9/2021 | Iwasaki | C10M 141/12 |
| 2022/0131205 | A1* | 4/2022 | Champagne | H01M 10/36 |
| 2022/0364010 | A1* | 11/2022 | Zhang | C10M 141/08 |
| 2022/0364011 | A1* | 11/2022 | Zhang | C10M 169/04 |
| 2022/0372392 | A1* | 11/2022 | Zhang | C10M 169/04 |

OTHER PUBLICATIONS

International Search Report for PCT/EP2021/061763 (PCT/ISA/210) mailed on Jul. 21, 2021.

* cited by examiner

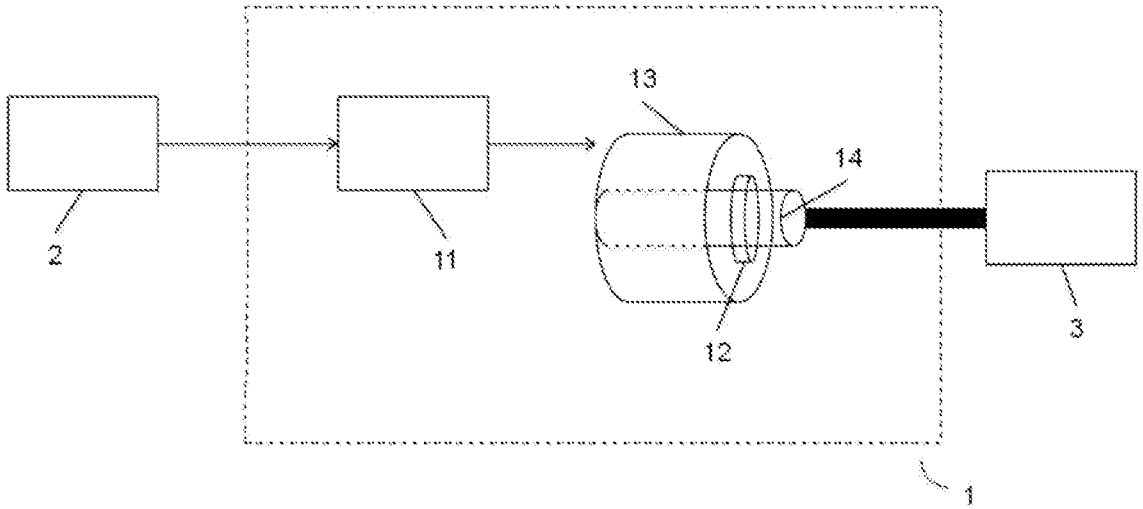
13
14
2
11
12
3
1

LUBRICATING COMPOSITION FOR ELECTRIC VEHICLES

TECHNICAL FIELD OF THE INVENTION

The present invention relates to the field of lubricating compositions for either electric or hybrid vehicles. Same relates more particularly to improving the resistivity and durability of lubricating compositions used in either electric or hybrid vehicles.

PRIOR ART

The evolution of international standards for the reduction of CO2 emissions, but also for the reduction of energy consumption, pushes car manufacturers to propose alternative solutions to internal combustion engines.

One of the solutions identified by car manufacturers is to replace internal combustion engines with electric motors. Research to reduce CO2 emissions has thus led a number of automotive companies to the development of electric vehicles.

In general, in vehicles it is necessary to use lubricating compositions, also known as "lubricants", for the main purpose of reducing the friction forces between the different parts of the vehicle propulsion system, in particular between moving metal parts in motors. Furthermore, such lubricating compositions are effective in preventing premature wear or even damage to such parts, and in particular, to the surface thereof.

Electric motors generate heat during operation. If the amount of heat generated is greater than the amount of heat normally dissipated into the environment, the engine requires cooling. In general, cooling is performed on one or a plurality of heat-generating parts of the engine and/or heat-sensitive parts of the engine so as to prevent hazardous temperatures being reached.

The cooling can be performed either by direct cooling or by indirect cooling. Due to the increasing increase in the power density of electric motors, it will be necessary to develop and improve the direct cooling mode of the electric motor where the lubricating fluid of the transmission part will be further used for cooling the hot parts of the electric motor. One example is the Tesla Model S vehicle, wherein the reduction gear lubricant also circulates through the hollow rotor of the electric motor to cool the stator coil heads via a plurality of jets of oil.

To this end, a lubricating composition is conventionally composed of one or a plurality of base oils, with which a plurality of additives are generally associated dedicated to stimulating the lubricating performance of the base oil, such as e.g. friction modifier additives.

For the sake of economy and ease of implementation, it would be advantageous to have a composition which simultaneously meets the lubrication and cooling requirements of a propulsion system (engine, battery, etc.) of an electric or hybrid vehicle. Unfortunately, at first glance, these two properties, namely lubrication and cooling, impose opposite constraints.

One type of performance particularly useful for a lubricating composition for propulsion systems of either electric or hybrid vehicles consists of having good properties relating to the resistance to wear, properties which are systematically part of the requirements to be met in the manufacturers' technical specifications.

Furthermore, such type of lubricating composition has to be apt to cool the propulsion systems of either electric or hybrid vehicles. The lubricant must also have insulating properties in order to avoid failure of the electrical components. In particular, a conductive lubricant can lead to a risk of leakage of electrical current at the stator and rotor winding, which thus reduces the efficiency of propulsion systems, and creates possible overheating of the electrical components, even up to the point of damaging the system. Hence, in the context of the implementation of lubricants for propulsion systems of either electric or hybrid vehicles, it is crucial that lubricants have good "electrical" properties in addition to lubricating properties.

The subject matter of the present invention is thus to provide a novel lubricating composition, particularly useful for either electric or hybrid vehicles, the properties of durability and electrical resistivity of which are improved.

SUMMARY OF THE INVENTION

More precisely, the present invention relates to a lubricating composition comprising at least one base oil and at least one additive chosen from antiwear additives, extreme pressure additives, antioxidants, anti-corrosion additives, metal deactivator additives, anti-foam agents, dispersants and mixtures thereof, said composition having a boron concentration of 100 ppm by weight or less and a nitrogen concentration strictly greater than 100 ppm by weight and less than or equal to 500 ppm by weight, with respect to the total weight of the lubricating composition.

According to one embodiment, the boron concentration is less than 50 ppm by weight, preferentially less than 10 ppm by weight, and/or the nitrogen concentration ranges from 200 to 500 ppm by weight, preferentially from 300 to 490 ppm by weight.

According to one embodiment, the composition according to the invention comprises at least 70% by weight of base oil(s), preferentially from 75 to 99% by weight of base oil(s), preferentially from 80 to 98% by weight of base oil(s), more preferentially from 85 to 95% by weight of base oil(s), with respect to the total weight of the lubricating composition.

According to one embodiment, the composition according to the invention has a kinematic viscosity at 100° C. ranging from 3 to 50 $mm^2/s$, preferentially from 4 to 25 $mm^2/s$, more preferentially from 5 to 10 $mm^2/s$.

According to one embodiment, the composition according to the invention has a kinematic viscosity at −10° C. ranging from 200 to 600 $mm^2/s$, preferentially from 250 to 500 $mm^2/s$, more preferentially from 275 to 400 $mm^2/s$.

According to one embodiment, the composition according to the invention comprises at least one dispersing additive which contains nitrogen.

The present invention further relates to the use of the lubricating composition according to the invention for lubricating and/or cooling a propulsion system of either an electric or hybrid vehicle.

According to one embodiment, the vehicle is an electric vehicle.

According to one embodiment, the lubricating composition according to the invention is used for lubricating and cooling a propulsion system of either an electric or hybrid vehicle.

According to one embodiment, the lubricating composition according to the invention is used for lubricating the reduction gear and for cooling the rotor.

"Propulsion system" as defined by the present invention, refers to a system comprising the mechanical parts required for the propulsion of a vehicle. In the context of an electric vehicle, the propulsion system thus encompasses more particularly an electric motor, or the rotor-stator assembly of power electronic systems (dedicated to speed regulation), a transmission also called a reduction gear, and a battery.

"Electric vehicle" as defined by the present invention refers to a vehicle comprising an electric motor as the only propulsion means, unlike a hybrid vehicle which comprises an internal combustion engine and an electric motor as combined propulsion means.

The lubricating composition according to the invention has improved resistivity and improved durability.

The lubricating composition according to the invention has the advantage of being apt to be used both for lubricating certain parts of a propulsion system of either an electric or hybrid vehicle and for cooling certain parts of a propulsion system of either an electric or hybrid vehicle.

Other features, variants and advantages of the implementation of the invention will become clearer upon reading the following description and the examples, given as an illustration of the invention, but not limited to.

Hereinafter in the text, the expressions "comprised between . . . and . . . ", "ranging from . . . to . . . " and "varying from . . . to . . . " are equivalent and mean that the limits are included, unless otherwise stated.

BRIEF DESCRIPTION OF FIGURES

FIG. 1 is a schematic representation of an electric motor drive system.

DETAILED DESCRIPTION OF THE INVENTION

The present invention relates to a lubricating composition comprising at least one base oil and at least one additive chosen from antiwear additives, extreme pressure additives, antioxidants, anti-corrosion additives, metal deactivator additives, anti-foam agents, dispersants and mixtures thereof, said composition having a boron concentration of 100 ppm by weight or less and a nitrogen concentration strictly greater than 100 ppm by weight and less than or equal to 500 ppm by weight, with respect to the total weight of the lubricating composition.

The nitrogen concentration can be determined as per the standard NF T 60-106. For the other elements, such as boron, the elemental concentration can be determined as per the ASTM standard D4951.

Base Oils

The lubricating composition according to the invention can thus comprise one or a plurality of base oils.

Such base oils can be chosen from base oils conventionally used in the field of lubricating oils, such as mineral oils, either synthetic or natural, animal or plant oils or mixtures thereof.

There can be a mixture of a plurality of base oils, e.g. a mixture of two, three, or four base oils.

The base oils used in the lubricating compositions according to the invention can be, in particular, mineral or synthetic oils belonging to groups I to V as per the classes defined by the API classification (or the equivalents thereof as per the ATIEL classification) and shown in Table 1 hereinafter, or mixtures thereof.

TABLE 1

| | Concentration of saturated | Sulfur concentration | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydro-isomerized or hydrocracked oils | ≥90% | ≤0.03% | ≥120 |
| Group IV | Polyalphaolefines (PAO) | | |
| Group V | Esters and other bases not included in groups I to IV | | |

The mineral base oils include any type of base oil obtained by atmospheric distillation and vacuum distillation of crude oil, followed by refining operations such as solvent extraction, deasphalting, solvent dewaxing, hydrotreatment, hydrocracking, hydroisomerization and hydrofinishing.

Mixtures of synthetic and mineral oils which can be biosourced, can be also used.

There is generally no limitation with regard to the use of different base oils for producing the compositions used according to the invention, except that the compositions have to have properties, in particular in terms of viscosity, viscosity index or resistance to oxidation, suitable for use in propulsion systems of either an electric or hybrid vehicle.

The base oils of the compositions used according to the invention can be further chosen from synthetic oils, such as certain carboxylic acid esters and alcohol esters, polyalphaolefins (PAO), and polyalkylene glycol (PAG) obtained by polymerization or copolymerization of alkylene oxides comprising from 2 to 8 carbon atoms, in particular from 2 to 4 carbon atoms.

The PAOs used as base oils are e.g. obtained from monomers comprising from 4 to 32 carbon atoms, e.g. from octene or decene. The weight-average molecular weight of the PAO can vary quite significantly. Preferentially, the weight-average molecular weight of the PAO is less than 600 Da. The weight-average molecular weight of the PAO can further range from 100 to 600 Da, from 150 to 600 Da, or further from 200 to 600 Da.

Advantageously, the base oil or oils of the composition according to the invention are chosen from polyalphaolefins (PAO), polyalkylene glycol (PAG) and esters of carboxylic acids and alcohols.

According to an alternative embodiment, the base oil or oils of the composition according to the invention can be chosen from the base oils of group II or III.

According to one embodiment, the lubricating composition according to the invention comprises at least one base oil of group II or III and at least one polyalphaolefin base oil.

A lubricating composition according to the invention can comprise at least 70% by weight of base oil(s) with respect to the total weight thereof, preferentially from 75 to 99% by weight of base oil(s), preferentially from 80 to 98% by weight of base oil(s), more preferentially from 85 to 95% by weight of base oil(s), with respect to the total weight thereof.

Additive(s)

The lubricating composition according to the invention comprises at least one additive chosen from anti-wear additives, extreme-pressure additives, antioxidants, anti-corrosion additives, metal deactivator additives, anti-foam agents, dispersants and mixtures thereof.

Such additive or additives are chosen in such a way that the lubricating composition will have (after addition of the additive or additives) a boron concentration less than or equal to 100 ppm by weight and a nitrogen concentration strictly greater than 100 ppm by weight and less than or equal to 500 ppm by weight, with respect to the total weight of the lubricating composition.

Preferentially, the boron concentration will be less than or equal to 50 ppm by weight, more preferentially less than or equal to 10 ppm by weight.

Preferentially, the nitrogen concentration will be greater than or equal to 200 ppm by weight, more preferentially greater than or equal to 300 ppm by weight.

Preferentially, the nitrogen concentration will be less than or equal to 490 ppm by weight.

According to one embodiment, the boron concentration ranges from 0.1 ppm to 10 ppm by weight, or even from 0.5 to 5 ppm by weight, and the nitrogen concentration ranges from 200 to 500 ppm by weight, or even from 300 to 490 ppm by weight.

Such additives can be introduced separately and/or as a mixture similar to the additives already available for sale for commercial lubricant formulations for vehicle engines, with a performance level as defined by ACEA (European Automobile Manufacturers Association) and/or API (American Petroleum Institute), well known to a person skilled in the art.

The lubricating composition can comprise e.g. at least one anti-wear additive.

Preferentially, for the lubricating composition according to the invention, the anti-wear additives are chosen from phosphorus-sulfur additives such as metal alkylthiophosphates, in particular zinc alkylthiophosphates, and more specifically zinc dialkyldithiophosphates or ZnDTP. Preferred compounds have the formula $Zn((SP(S)(OR^2)(OR^3))_2$, wherein $R^2$ and $R^3$—are either identical or different—independently represent an alkyl group, preferentially an alkyl group comprising from 1 to 18 carbon atoms.

Amine phosphates as well are anti-wear additives which can be used in the lubricating compositions according to the invention. However, the phosphorus provided by such additives can act as a poison in the catalytic systems of cars since same generate ash. Such effects can be minimized by partially substituting the amine phosphates with additives which do not carry in phosphorous, such as effect polysulfides, in particular sulfur-containing olefins.

A lubricating composition according to the invention can comprise from 0.01 to 15%, preferentially 0.1 to 10% by weight, preferentially 1 to 5% by weight of anti-wear agent(s), with respect to the total weight of the composition.

The lubricating composition can comprise e.g. at least one antioxidant.

The antioxidant additive generally makes it possible to delay the degradation of the composition in service. Such degradation most often shows as a deposit formation, as the presence of sludge or as an increase in the viscosity of the composition.

Antioxidant additives in particular act as radical inhibitors or destroyers of hydroperoxides. The antioxidant additives commonly used include phenolic antioxidants, amine antioxidant additives, phosphosulfur antioxidant additives. Some of such antioxidant additives, e.g. phosphosulfur antioxidant additives, can generate ashes. The phenolic antioxidant additives can be without ashes or in the form of neutral or basic metal salts. The antioxidant additives can in particular be chosen from sterically hindered phenols, sterically hindered phenol esters and sterically hindered phenols comprising a thioether bridge, diphenylamines, diphenylamines substituted with at least one C1-C12 alkyl group, N,N'-dialkyl-aryl-diamines and mixtures thereof.

Preferentially, according to the invention, the sterically hindered phenols are chosen from compounds comprising a phenol group of which at least one of the carbons neighboring the carbon atom bearing the alcohol function, is substituted by at least one $C_1$-$C_{10}$ alkyl group, preferentially a $C_1$-$C_6$ alkyl group, preferentially a $C_4$ alkyl group, preferentially a tert-butyl group.

Amine compounds are another class of antioxidant additives which can be used, if appropriate, in combination with phenolic antioxidant additives. Examples of amine compounds are aromatic amines, e.g. aromatic amines with the formula $NR^4R^5R^6$ wherein $R^4$ represents an aliphatic group or a possibly substituted aromatic group, $R^5$ represents a possibly substituted aromatic group, $R^6$ represents a hydrogen atom, an alkyl group, an aryl group or a group with the formula $R^7S(O)_zR^8$ wherein $R^7$ represents an alkylene or an alkenylene group, $R^8$ represents an alkyl group, an alkenyl group or an aryl group and z is 0, 1 or 2.

Sulfur alkyl phenols or the alkali or alkaline-earth metal salts thereof can be further used as antioxidant additives.

Another class of antioxidant additives is the class of copper compounds, e.g. copper thio- or dithio-phosphate, copper salts and carboxylic acid salts, copper dithiocarbamates, copper sulfonates, copper phenates, copper acetylacetonates. Copper salts I and II, succinic acid salts or succinic anhydride salts can be used as well.

A lubricating composition used according to the invention can further comprise any type of antioxidant known to a person skilled in the art.

Advantageously, the lubricating composition used according to the invention comprises at least one antioxidant additive without ashes.

A lubricating composition used according to the invention can comprise 0.01 to 2% by weight of at least one antioxidant additive, with respect to the total weight of the composition.

The lubricating composition can comprise e.g. at least one anti-corrosion additive.

The anti-corrosion additive advantageously makes it possible to delay or prevent corrosion in the metal parts of the propulsion system, and in particular corrosion in the bearings located between the rotor and the stator of an electric motor, generally made of copper.

A lubricating composition according to the invention can comprise from 0.01 to 2% by weight or from 0.01 to 5% by weight, preferentially from 0.1 to 1.5% by weight or from 0.1 to 2% by weight of anti-corrosion agent, with respect to the total weight of the composition.

The lubricating composition can comprise e.g. at least one metal deactivator additive.

The metal deactivator additive can be chosen from tolutriazole, benzotriazoles which are possibly substituted by alkyl groups, triazoles possibly substituted by alkyl groups, or dimercaptothiadiazole.

A lubricating composition according to the invention can comprise from 0.01 to 2% mass percent or from 0.01 to 5% mass percent, preferentially from 0.1 to 1.5% mass percent or from 0.1 to 2% mass percent of metal deactivator additive, with respect to the total weight of the composition.

The lubricating composition can comprise e.g. at least one anti-foam agent.

Preferentially, the anti-foam agent is chosen from polyacrylates, waxes and polyorganosiloxanes.

A lubricating composition according to the invention can comprise from 0.01 to 2% by weight or from 0.01 to 5% by weight, preferentially from 0.1 to 1.5% by weight or from 0.1 to 2% by weight of anti-foam agent, with respect to the total weight of the composition.

The lubricating composition can comprise e.g. at least one dispersant.

The dispersant can be chosen from Mannich bases, succinimides, e.g. polyisobutylene succinimides.

A lubricating composition according to the invention can comprise e.g. from 0.05 to 5% by weight of dispersants, preferentially from 0.1 to 3% mass percent or from 0.1 to 2% mass percent of anti-foam agent, with respect to the total weight of the composition.

Additional Additives

The lubricating composition can further comprise one or a plurality of other additives, different from the above-defined additives, e.g. chosen from friction modifiers, detergents and pour point depressants.

The friction modifier additives can be chosen from compounds providing metallic elements and ashless compounds. Compounds providing metal elements include complexes of transition metals such as Mo, SB, Sn, Fe, Cu, Zn the ligands of which can be hydrocarbon compounds comprising oxygen, nitrogen, sulfur or phosphorus atoms. Ashless friction modifier additives are generally of organic origin and can be chosen from fatty acid and polyol monoesters, alkoxylated amines, alkoxylated fatty amines, fatty epoxides, fatty epoxide borates; fatty amines or fatty acid glycerol esters. According to the invention, fatty compounds comprise at least one hydrocarbon group comprising from 10 to 24 carbon atoms.

A lubricating composition according to the invention can comprise from 0.01 to 2% by weight or from 0.01 to 5% by weight, preferentially from 0.1 to 1.5% by weight or from 0.1 to 2% by weight of friction modifier additive, with respect to the total weight of the composition.

Detergent additives generally reduce the formation of deposits on the surface of metal parts, by dissolving oxidation and combustion by-products.

The detergent additives which can be used in the lubricating compositions according to the invention are generally known to a person skilled in the art. The detergent additives can be anionic compounds comprising a long lipophilic hydrocarbon chain and a hydrophilic head. The associated cation can be a metal cation of an alkali or alkaline earth metal.

The detergent additives are preferentially chosen from alkali metal salts or alkaline-earth metal salts of carboxylic acid, sulphonates, salicylates, naphthenates, as well as phenate salts. The alkali metals and alkaline earth metals are preferentially calcium, magnesium, sodium or barium.

Such metal salts generally include the metal in a stoichiometric amount or in an excess amount, i.e. in a concentration greater than the stoichiometric amount. Same are then overbased detergents; the metal in excess which gives the overbased character to the detergent additive is generally in the form of an oil-insoluble metal salt, e.g. a carbonate, a hydroxide, an oxalate, an acetate, a glutamate, preferentially a carbonate.

A lubricating composition according to the invention can comprise from 0.05 to 4% by weight of detergent additive, with respect to the total weight of the composition.

A lubricating composition according to the invention can further comprise at least one pour point depressant additive (also known as PPD).

By slowing down the formation of paraffin crystals, the pour point depressant additive generally improves the behavior of the composition under cold conditions. Examples of pour point depressant additives include alkyl polymethacrylates, polyacrylates, polyarylamides, polyalkylphenols, polyalkylnaphthalene, alkyl polystyrenes.

In terms of the formulation of such a lubricating composition, said additive(s) can be added to an oil or to mixture of base oils, followed by the other additional additives added.

Alternatively, said additive(s) can be added to a pre-existing conventional lubricating formulation, comprising in particular one or a plurality of base oils and one or a plurality of supplementary additives.

Alternatively, all additives can be formulated together in a package of additives, and the package of additives thus formed is added to a base oil or mixture of base oils.

The total amount of additives in the lubricating composition is adapted so as to obtain the boron and nitrogen concentrations as defined in the present invention.

Lubricating Composition According to the Invention

Advantageously, the lubricating composition according to the invention has a kinematic viscosity, measured at 100° C. as per the ISO standard 3104, ranging from 3 to 50 $mm^2/s$, preferentially from 4 to 25 $mm^2/s$, more preferentially from 5 to 10 $mm^2/s$.

Advantageously, the lubricating composition according to the invention has a kinematic viscosity, measured at −10° C. as per the ISO standard 3104, ranging from 200 to 600 $mm^2/s$, preferentially from 250 to 500 $mm^2/s$, more preferentially from 275 to 400 $mm^2/s$.

Advantageously, the lubricating composition according to the invention has a kinematic viscosity at −40° C., measured as per the ASTM standard D2983, ranging from 3,000 to 10,000 mPa·s, preferentially from 4,000 to 9,000 mPa·s, more preferentially from 4,500 to 8,800 mPa·s.

Advantageously, the lubricating composition according to the invention comprises calcium, in a concentration ranging from 250 to 450 ppm, preferentially ranging from 300 to 400 ppm by weight, with respect to the total weight of the lubricating composition.

Advantageously, the lubricating composition according to the invention is substantially free of molybdenum, i.e. if the composition comprises molybdenum, the composition will typically comprise less than 1 ppm of molybdenum.

Advantageously, the lubricating composition according to the invention comprises phosphorus, preferentially in a concentration ranging from 50 to 1000 ppm by weight, preferentially ranging from 100 to 500 ppm by weight, with respect to the total weight of the lubricating composition.

Advantageously, the lubricating composition according to the invention comprises sulfur, preferentially in a concentration ranging from 50 to 2000 ppm, preferentially ranging from 100 to 1500 ppm by weight, with respect to the total weight of the lubricating composition.

Thereby, according to one embodiment, the lubricating composition according to the invention comprises:

- a boron concentration ranging from 0.1 ppm to 10 ppm by weight, or even from 0.5 to 5 ppm by weight, and
- a nitrogen concentration ranging from 200 to 500 ppm by weight, or even from 300 to 490 ppm by weight, and
- a calcium concentration ranging from 150 to 1,000 ppm by weight, or even from 200 to 500 ppm by weight, and
- a phosphorus concentration ranging from 50 to 1,000 ppm, or even from 100 to 500 ppm by weight, and
- a sulfur concentration ranging from 50 to 2,000 ppm, or even from 100 to 1,500 ppm.

According to an advantageous embodiment of the present invention, the electrical resistivity values measured at 90° C. of the lubricating compositions according to the invention are comprised between 5 and 10,000 Mohm·m, still preferentially between 6 and 5,000 Mohm·m.

According to one embodiment, the lubricating composition according to the invention comprises, or even consists of:

- a base oil or a mixture of base oils, preferentially chosen from polyalphaolefins (PAO), polyalkylene glycol (PAG), esters of carboxylic acid and alcohols, Group II base oils and Group III base oils, preferentially chosen from polyalphaolefins (PAO), and Group III base oils;
- at least one dispersant additive, preferentially chosen from succinimides, such as polyisobutylene succinimides,
- optionally one or a plurality of additives chosen from anti-wear additives, extreme pressure additives, antioxidants, anti-corrosion additives, metal deactivator additives, anti-foam agents, and mixtures thereof.

According to one embodiment, the lubricating composition according to the invention comprises, or even consists of:

- from 0.05% to 5% by weight, preferentially from 0.1% to 3% by weight, preferentially from 0.1% to 2% by weight, of dispersant(s), preferentially succinimide(s);
- at least 70% by weight, preferentially from 80% to 99.95% by weight of base oil(s), preferentially chosen from polyalphaolefins (PAO), polyalkylene glycol (PAG), esters of carboxylic acids and alcohols, Group II base oils and Group III base oils, preferentially from polyalphaolefins (PAO), Group II base oils and Group III base oils;
- optionally from 0.1% to 10% by weight of one or more additives chosen from anti-wear additives, extreme-pressure additives, antioxidants, anti-corrosion additives, metal deactivator additives, anti-foam agents, and mixtures thereof;
- the concentrations being expressed with respect to the total weight of said lubricating composition.

Applications

The present invention further relates to the use of the lubricating composition according to the invention for lubricating and/or cooling a propulsion system of either an electric or hybrid vehicle.

According to one embodiment of the invention, the lubricating composition is applied for lubricating at least one element chosen from the gearbox, the transmission, the motor, and the reduction gear.

FIG. 1 is a schematic representation of the electric motor drive system.

The motor of an electric vehicle (1) comprises power electronic system (11) connected to a stator (13) and a rotor (14). The rotational speed of the rotor is very high, which involves adding a speed reduction gear (3) between the electric motor (1) and the wheels of the vehicle.

The stator comprises coils, in particular copper coils, which are alternately supplied with an electric current. In this way, a rotating magnetic field is generated. The rotor as such comprises coils or permanent magnets or other magnetic materials and is rotated by the rotating magnetic field.

The power electronics system, the stator and the rotor of an electric motor are parts which have a complex structure and generate a large amount of heat during the motor functioning. For this reason, the lubricating composition according to the invention is more specifically used for cooling the power electronics system and/or the rotor and/or the stator of the electric motor.

In a preferred embodiment, the invention relates to the use of a lubricating composition as defined in the present invention for cooling the power electronics system, the rotor and the stator of the electric motor.

A bearing (12) for holding the rotation shaft is also integrated between the rotor and the stator. The bearing is subject to high mechanical stresses and poses problems of fatigue wear. It is thus necessary to lubricate the bearing in order to increase the service life thereof. For this reason, the lubricating composition as defined above is also used for lubricating the motor of an electric vehicle.

In a preferred embodiment, the invention relates to the use of a lubricating composition as defined in the present invention, for lubricating the bearings located between the rotor and the stator.

The reduction gear (3), which is part of the transmission, has the function of reducing the rotational speed at the output of the electric motor and of adapting the speed transmitted to the wheels, making it possible at the same time to control the speed of the vehicle. The reduction gear is subjected to high frictional stresses and thus needs to be lubricated in a suitable manner so as to prevent same from being damaged too quickly. For this reason, the lubricating composition as defined in the present invention is also used for lubricating the reduction gear and the transmission of an electric vehicle.

In a preferred embodiment, the invention relates to the use of a lubricating composition as defined in the present invention, for lubricating the reduction gear of an electric vehicle.

The invention further relates to the use of a lubricating composition as defined in the present invention, for cooling the power electronics system and/or the rotor/stator pair and for lubricating the reduction gear and/or the bearings of the rotor/stator pair of an electric vehicle motor.

The invention further relates to the use of a lubricating composition as defined in the present invention for cooling the battery of an electric vehicle.

Indeed, the electric motor is powered by an electric battery (2). Lithium-ion batteries are the most widespread in the field of electric vehicles. The development of increasingly powerful batteries the size of which is increasingly smaller involves the problem of cooling the battery. Indeed, when the battery exceeds temperatures on the order of 50 to 60° C., there is a high risk that the battery will ignite or even explode. There is also a need to keep the battery at a temperature above about 20 to 25° C. so as to prevent the battery from discharging too quickly and to prolong the service life thereof. There is thus a need to keep the battery at an acceptable temperature.

The invention further relates to the use of a composition as defined in the present invention, for cooling the battery and the motor of an electric vehicle.

The invention further relates to the use of a lubricating composition as defined in the present invention for cooling an electric motor of a hybrid vehicle.

All the features and preferences described for the lubricating composition according to the invention also apply to the uses thereof.

The invention further relates, according to another of the aspects thereof, to a method for lubricating and/or cooling a propulsion system of either an electric or hybrid vehicle, said method comprising implementing the lubricating composition according to the invention with at least one metal part of the propulsion system of either an electric or hybrid vehicle.

The process according to the invention thus comprises at least one step during which the metal part is lubricated and/or cooled.

According to one embodiment of the use and/or of the method according to the invention, the lubricating composition can be used both for lubricating one part and for cooling another part of the propulsion system. Preferentially, the lubricating composition according to the invention makes it possible to lubricate the reduction gear and to cool the rotor.

The lubricating composition according to the invention is particularly advantageous in that same significantly improves the durability and the resistivity. In fact, the boron and nitrogen concentrations make it possible to obtain, surprisingly, a lubricating composition exhibiting improved resistivity and improved durability.

The resistivity of the lubricating composition is maintained at a high level for a long time, i.e. even after prolonged use of the lubricating composition. In other words, the resistivity of the lubricating composition according to the invention deteriorates less than the resistivity of prior art lubricating compositions, which do not contain the claimed concentrations of boron and nitrogen.

In addition to having a good resistivity, the lubricating composition according to the invention has a resistivity lasting over time, i.e. during the use (the implementation) of the lubricating composition in the propulsion system.

According to the invention, the particular, advantageous or preferred features of the lubricating composition according to the invention make it possible to define uses according to the invention which are also particular, advantageous or preferred.

The invention will now be described by means of the following examples, given of course as an illustration of the invention, but not limited to.

EXAMPLES

Example 1: Description of Lubricating Compositions

Four lubricant compositions were tested and compared:

- a commercial lubricant composition CC1 from a supplier,
- a commercial CC2 lubricant composition from another supplier,
- a lubricating composition CI1 according to the invention, comprising about 96.75% by weight of base oils, 0.5% by weight of a viscosity modifier additive, and 2.75% by weight of a package of additives,
- a lubricating composition CI2 according to the invention, comprising 91.1% by weight of a base oil, 5.6% by weight of viscosity modifier additive, and 3.3% by weight of an additive package.

The lubricating compositions CI1 and CI2 were prepared by mixing the ingredients, typically at a temperature on the order of 40° C.

Table 2 below show together the characteristics of the compositions.

TABLE 2

| | | Method | CI1 | CI2 | CC1 | CC2 |
|---|---|---|---|---|---|---|
| Kinematic viscosity ($mm^2/s$) | −10° C. | ISO 3104 | 304.6 | 356.8 | 406.7 | 328.6 |
| | 25° C. | | 42.68 | 48.53 | 50.16 | 43.18 |
| | 40° C. | | 23.66 | 26.76 | 26.43 | 23.9 |
| | 100° C. | | 5.22 | 5.80 | 5.79 | 5.40 |
| Viscosity index | | ASTM D2270 | 161 | 168 | 171 | 168 |
| Low temperature viscosity (mPa · s) | −30° C. | ASTM D2983 | 1721 | 1750 | 2080 | |
| | −40° C. | | 5710 | 8500 | 7070 | 8600 |
| Elemental analysis (ppm by weight) | N | NF T 60-106 | 365 | 480 | 1405 | 1756 |
| | B | ASTM D4951 | 1 | 1 | 140 | 63 |
| | Ca | | 273 | 331 | 125 | 123 |
| | P | | 226 | 261 | 285 | 304 |
| | S | | 800 | 1100 | 1000 | 630 |
| | Mo | | <1 | <1 | | |

Example 2: Investigation on the Electrical Properties of Lubricating Compositions The electrical properties of the lubricating compositions described in example 1 were measured and are shown in Table 3.

TABLE 3

| | | Method | CI1 | CI2 | CC1 | CC2 |
|---|---|---|---|---|---|---|
| Dielectric breakdown (kV) | 23° C. | IEC 60156 | >94 | 82 | 66 | 64 |
| Permittivity | 23° C. | IEC 60247 | 2.111 | 2.211 | | |
| | 90° C. | | 2.042 | 2.131 | | |
| New oil resistivity (MOhm · m) | 23° C. | IEC 60247 | 1070 | 694.1 | 502 | 534 |
| | 90° C. | | 59 | 40 | 22 | 32 |
| Used oil resistivity* (MOhm · m) | 23° C. | IEC 60247 | 854 | 619 | 241 | 384 |
| | 90° C. | | 65 | 40 | 27 | 33 |
| Dissipation factor (tan delta) at 50 Hz new oil | 23° C. | IEC 60247 | 0.28 | 0.32 | | 0.33 |
| | 90° C. | | 3.63 | 4.75 | | 5.18 |

TABLE 3-continued

| | | Method | CI1 | CI2 | CC1 | CC2 |
|---|---|---|---|---|---|---|
| Dissipation factor (tan delta) at 50 Hz used oil* | 23° C. | IEC 60247 | 0.42 | 0.47 | 0.90 | 0.59 |
| | 90° C. | | 4.94 | 5.51 | 8.73 | 6.08 |

*the used oil corresponds to the oil after the GFC-Tr-41-A test.

The results of Table 3 show that the lubricating composition according to the invention has very good electrical properties, and in particular a very good resistivity. Furthermore, the good resistivity is maintained over time since the test on "waste oil" makes it possible to simulate the wear of the lubricating composition and thus the degradation thereof during the use thereof, and the results on waste oil show that the properties are maintained, and in particular the resistivity is maintained over the time of use of the composition.

Example 3: Study of the anti-wear and extreme-pressure properties of lubricating compositions The anti-wear and extreme-pressure properties of the lubricating compositions described in example 1 were measured and are indicated in Table 4.

TABLE 4

| | | Method | CC1 | CC2 | CI1 | CI2 |
|---|---|---|---|---|---|---|
| 4-ball test 1500 rpm | Last load before breakdown (kgf)(1) | ASTM D2783 | | | 80 | 80 |
| | Wear scar diameter (mm) (2) | | | | 0.55 | 0.51 |
| FZG load test | Number of load steps(3) | | 6 | 5 | 8 | 8 |
| | Time(4) | | NOK | | >50 | >50 |

The test conditions in Table 4 are as follows:

(1)Extreme-pressure diagram from 60 kgf, load increase in steps from 10 kgf up to 150 kgf (2) Anti-wear 40 kgf/1 hour (3)A10/16.6R/120° C. extreme pressure test conducted as per the CEC L-84-02 standard (4)C (type of teeth) pitting test/1440 rpm (speed of rotation)/bearing 9 (load applied during the test)/120° C. (temperature of the test). The result "NOK" indicates that the composition CC1 did not pass such test.

The results in Table 4 show that the compositions according to the invention have very good anti-wear and extreme-pressure properties.

Example 4: Study of Shear Stability

The shear stability of the lubricating compositions described in example 1 was measured and is shown in Table 5.

TABLE 5

| | | Method | CC1 | CC2 | CI1 | CI2 |
|---|---|---|---|---|---|---|
| Kinematic viscosity at 100° C. after the KRL test | After 20 h | CEC L-45-A-99 | 5.686 | 5.156 | 5.03 | 5.5 |
| | After 72 h | | | | 5.00 | 5.26 |
| | After 192 h | | 5.443 | 4.83 | 4.98 | 5.18 |

The results of Table 5 show that the compositions according to the invention exhibit good shear stability.

Example 5: Compositions CI3 and CC3

Compositions CI3 and CC3 were prepared in a similar manner to compositions CI1 and CI2 (example 1).

Composition CI3 comprises 91.6% by weight of a base oil, 5.1% by weight of a viscosity modifier additive and 3.3% by weight of a package of additives including an anti-foam agent and a metal deactivator.

Composition CC3 differs from composition CI3 in that same further comprises 0.3% by weight of calcium sulphonate detergent additive (the amount of base oil is thus 91.3% by weight in the composition CC3).

The elemental composition of compositions CI3 and CC3 is shown in Table 6.

The extreme-pressure properties of compositions CI3 and C3 are measured and indicated in Table 6, using the same method as the method described in example 3.

The resistivity on new oil of the two compositions CI3 and CC3 was measured and indicated in Table 6, using the same method as the method described in example 2.

TABLE 6

| | | Method | CI3 | CC3 |
|---|---|---|---|---|
| Kinematic viscosity ($mm^2/s$) | 40° C. | ISO 3104 | 26.76 | 26.90 |
| | 100° C. | | 5.80 | 5.836 |
| Viscosity index | | ASTM D2270 | 168 | 169 |
| Elemental analysis (ppm by weight) | N | NF T 60-106 | 480 | 531 |
| | B | ASTM D4951 | <1 | <1 |
| | Ca | | 331 | 711 |
| | P | | 261 | 252 |
| | S | | 1100 | 1140 |
| | Mo | | <1 | <1 |
| FZG load test | Number of load steps | | 9 | 7 |
| New oil resistivity (MOhm · m) | 90° C. | IEC 60247 | 40 | 18.5 |

Table 6 shows that composition C13 comprising 331 ppm by weight of calcium has better extreme-pressure properties and better electrical resistivity than composition CC3 comprising 711 ppm by weight of calcium.

A lower calcium concentration, combined with the claimed amounts of boron and nitrogen, improves the extreme-pressure properties of lubricant compositions.

The invention claimed is:

1. Lubricating composition comprising at least one base oil and at least one additive selected from anti-wear additives, extreme pressure additives, antioxidants, anti-corrosion additives, metal deactivator additives, anti-foam agents, dispersants and mixtures thereof, said composition having a boron concentration of 10 ppm by weight or less, a nitrogen concentration ranging from 300 to 490 ppm by weight, a calcium concentration ranging from 200 to 500 ppm by weight, a phosphorous concentration ranging from 100 to 500 ppm by weight, and a sulfur concentration ranging from 100 to 1500 ppm by weight, with respect to the total weight of the lubricating composition.

2. The composition according to claim 1, comprising at least 70% by weight of base oil(s), with respect to the total weight of the lubricating composition.

3. The composition according to claim 1, having a kinematic viscosity at 100° C. ranging from 3 to 50 $mm^2/s$.

4. The composition according to claim 1, having a kinematic viscosity at −10° C. ranging from 200 to 600 $mm^2/s$.

5. The composition according to claim 1, comprising at least one dispersant additive which contains nitrogen.

6. A method for lubricating and/or cooling a propulsion system of either an electric or hybrid vehicle, the method comprising implementing the lubricating composition according to claim 1 with at least one metal part of the propulsion system of either an electric or hybrid vehicle.

7. The method according to claim 6, wherein the vehicle is an electric vehicle.

8. The method according to claim 6, for lubricating and cooling a propulsion system of either an electric or hybrid vehicle.

9. The method according to claim 6, for lubricating the reduction gear and for cooling the rotor.

10. The composition according to claim 1, comprising from 75 to 99% by weight of base oil(s), with respect to the total weight of the lubricating composition.

11. The composition according to claim 1, comprising from 80 to 98% by weight of base oil(s), with respect to the total weight of the lubricating composition.

12. The composition according to claim 1, comprising from 85 to 95% by weight of base oil(s), with respect to the total weight of the lubricating composition.

13. The composition according to claim 1, having a kinematic viscosity at 100° C. ranging from 4 to 25 $mm^2/s$.

14. The composition according to claim 1, having a kinematic viscosity at 100° C. ranging from 5 to 10 $mm^2/s$.

15. The composition according to claim 1, having a kinematic viscosity at −10° C. ranging from 250 to 500 $mm^2/s$.

16. The composition according to claim 1, having a kinematic viscosity at −10° C. ranging from 275 to 400 $mm^2/s$.

17. Lubricating composition comprising at least one base oil and at least one additive selected from anti-wear additives, extreme pressure additives, antioxidants, anti-corrosion additives, metal deactivator additives, anti-foam agents, dispersants and mixtures thereof, said composition having a boron concentration of 10 ppm by weight or less, a nitrogen concentration ranging from 300 ppm to 490 ppm by weight and a calcium concentration ranging from 200 to 500 ppm by weight, with respect to the total weight of the lubricating composition, said lubricating composition having a kinematic viscosity at −10° C. ranging from 200 to 600 $mm^2/s$, said composition comprising a viscosity modifier additive.

* * * * *